US009997171B2

(12) United States Patent
De Vries et al.

(10) Patent No.: US 9,997,171 B2
(45) Date of Patent: Jun. 12, 2018

(54) MULTI-BAND SIGNAL PROCESSOR FOR DIGITAL AUDIO SIGNALS

(71) Applicant: GN HEARING A/S, Ballerup (DK)

(72) Inventors: Aalbert De Vries, Eindhoven (NL); Erik Cornelis Diederik Van Der Werf, Eindhoven (NL)

(73) Assignee: GN HEARING A/S, Ballerup (DK)

( * ) Notice: Subject to any disclaimer, the term of this patent is extended or adjusted under 35 U.S.C. 154(b) by 156 days.

(21) Appl. No.: 14/269,773

(22) Filed: May 5, 2014

(65) Prior Publication Data

US 2015/0317995 A1 Nov. 5, 2015

(30) Foreign Application Priority Data

May 1, 2014 (DK) ..... PA 2014 70269
May 1, 2014 (EP) ..... 14166783

(51) Int. Cl.
*H04R 25/00* (2006.01)
*G10L 21/0364* (2013.01)
(Continued)

(52) U.S. Cl.
CPC ..... *G10L 21/0364* (2013.01); *G10L 19/02* (2013.01); *G10L 19/265* (2013.01);
(Continued)

(58) Field of Classification Search
CPC ..... H04B 1/0475; H03F 1/3247
(Continued)

(56) References Cited

U.S. PATENT DOCUMENTS 5,956,674 A * 9/1999 Smyth et al. ..... 704/200.1
2002/0094100 A1* 7/2002 Kates et al. ..... 381/318
(Continued)

FOREIGN PATENT DOCUMENTS

EP 1981309 A1 10/2008
EP 2003928 A1 12/2008
(Continued)

OTHER PUBLICATIONS

Extended European Search Report dated Jan. 30, 2015, for corresponding EP Patent Application No. 14166783.2, 5 pages.
(Continued)

*Primary Examiner* — Shreyans Patel
(74) *Attorney, Agent, or Firm* — Vista IP Law Group, LLP

(57) ABSTRACT

A method includes: processing the digital audio input signal to generate M delayed digital audio signal samples; converting the delayed digital audio signal samples to frequency domain representation in N number of frequency bands to compute respective signal spectrum values; determining respective signal level estimates; computing respective frequency domain gain coefficients based on the respective signal level estimates and band gain laws; transforming the frequency domain gain coefficients to time domain representation to produce M time-varying filter coefficients of a processing filter; convolving the M delayed digital audio signal samples with the time-varying filter coefficients to produce the processed digital output signal; and updating the delayed digital audio signal samples in accordance with a sample-by-sample or a predetermined block rate; wherein two of the signal spectrum values for at least two of the frequency bands are updated at different rates; and wherein M and N are positive integer numbers.

15 Claims, 5 Drawing Sheets

(51) Int. Cl.
*G10L 19/26* (2013.01)
*G10L 19/02* (2013.01)
*H04S 7/00* (2006.01)

(52) U.S. Cl.
CPC ..... *H04R 25/356* (2013.01); *H04R 25/505* (2013.01); *H04S 7/00* (2013.01); *H04S 2420/01* (2013.01)

(58) Field of Classification Search
USPC ..... 704/206; 381/316, 318
See application file for complete search history.

(56) References Cited

U.S. PATENT DOCUMENTS

| | | | | |
|---|---|---|---|---|
| 2003/0081804 | A1* | 5/2003 | Kates | 381/316 |
| 2003/0108214 | A1 | 6/2003 | Brennan et al. | |
| 2012/0243638 | A1* | 9/2012 | Maltsev et al. | 375/316 |
| 2013/0094589 | A1* | 4/2013 | Rosewarne | 375/240.18 |
| 2013/0287236 | A1 | 10/2013 | Kates | |

FOREIGN PATENT DOCUMENTS

| | | | |
|---|---|---|---|
| WO | WO 03/015468 | A1 | 2/2003 |
| WO | WO 2005/101959 | A2 | 11/2005 |
| WO | WO 2007/025569 | A1 | 3/2007 |
| WO | WO 2011/000408 | A1 | 1/2011 |

OTHER PUBLICATIONS

Harma et al., "Frequency-Warped Signal Processing for Audio Applications", Journal of the Audio Engineering Society, Audio Engineering Society, New York, NY, US, vol. 48, No. 11, Nov. 1, 2000, 22 pages.

First Technical Examination and Search Report dated Aug. 1, 2014, for related DK Patent Application No. PA 2014 70269, 5 pages.

Second Technical Examination—Intention to Grant dated Jan. 30, 2015, for corresponding Danish Patent Application No. PA 2014 70269, 3 pages.

* cited by examiner

A)

B)

MULTI-BAND SIGNAL PROCESSOR FOR DIGITAL AUDIO SIGNALS

RELATED APPLICATION DATA

This application claims priority to, and the benefit of, Danish Patent Application No. PA 2014 70269, filed on May 1, 2014, pending, and European Patent Application No. 14166783.2, filed on May 1, 2014, pending. The entire disclosures of both of the above applications are expressly incorporated by reference herein.

FIELD

The present disclosure relates to multi-band signal processors.

BACKGROUND

Hearing instruments or hearing aids typically comprise a microphone amplification assembly which includes one or several microphones for receipt of incoming sound such as speech and music. The incoming sound is converted to an electric microphone signal or signals that are amplified and processed in a control and processing circuit of the hearing instrument in accordance with one or more preset listening program(s). These listening programs have typically been computed from a user's specific hearing deficit or loss for example expressed in an audiogram. An output amplifier of the hearing instrument delivers the processed microphone signal to the user's ear canal via a miniature speaker or receiver that may be housed in a casing of the hearing instrument together with the microphone or separately in an ear plug.

A hearing impaired person typically suffers from a loss of hearing sensitivity which loss is dependent upon both frequency and the level of the sound in question. Thus a hearing impaired person may be able to hear certain frequencies (e.g., low frequencies) as well as a normal hearing person, but unable to hear sounds with the same sensitivity as the non-hearing impaired person at other frequencies (e.g., high frequencies). Similarly, the hearing impaired person may be perceive loud sounds, e.g. above 90 dB SPL, with the same intensity as the non-hearing impaired person, but unable to hear soft sounds with the same sensitivity as the non-hearing impaired person. Thus, in the latter situation, the hearing impaired person suffers from a loss of dynamic range at certain frequencies or frequency bands. A variety of prior analog and digital hearing aids have been designed to mitigate the above-identified hearing deficiency with loss of dynamic range. To compensate for the loss of dynamic range, prior art hearing instruments have used a so-called multi-band dynamic range compressor to compress the dynamic range of the incoming sound such that the compressed output signal more closely matches the dynamic range of the intended user. The ratio of the input dynamic range to the dynamic range output by the multi-band dynamic range compressor is referred to as the compression ratio. Typically, the multi-band dynamic range compressor is configured to perform differently, e.g. different compression ratios and/or different attack and release time constants, in different frequency bands to accounting for the frequency dependent loss of dynamic range of the intended hearing impaired user.

U.S 2003/0081804 discloses a so-called side-branch architecture for a multi-band dynamic range compressor based on the Fast Fourier Transform (FFT). The multi-band dynamic range compressor uses a side branch for the frequency analysis of the audio input signal. The FFT is computed on a warped frequency scale from outlet taps of a cascade of first-order all-pass filters to which the audio input signal is applied. The same tapped delay line is used for both the FFT analysis and a time-varying FIR compression filter. Results of the FFT based frequency analysis are used to generate the coefficients of the FIR compression filter placed in the signal path.

The warped frequency scale and side-branch architecture of the disclosed multi-band dynamic range compressor result in numerous desirable properties such as minimal time delay as the direct signal path contains only a short input buffer and the FIR compression filter. Other noticeable advantages are absence of aliasing and a natural log-scaling of the analysis frequency bands conforming nicely to the Bark based frequency scale of human hearing. However, the disclosed FFT-based multi-band dynamic range compressor suffers from certain undesired properties. In particular, signal spectrum values of all frequency bands of the FFT based analysis are updated at the same block rate or frequency which may lead to undersampling of high frequency components of the input sound. Undersampling of the high frequency components is generally undesirable as it may cause aliasing of spectral level estimates in the analysis frequency bands and result in misbehaving and distortion inducing compression gain agents or coefficients.

Furthermore, while a relatively high block rate may be selected in the FFT based multi-band dynamic range compressor to accommodate the high frequency components, this will lead to a faster update of low frequency bands of the analysis filter than required for correct sampling, i.e. oversampling of the low frequency bands. While the latter oversampling property does not cause aliasing distortion, it wastes computational resources of a signal processor of the hearing instrument executing the FFT-based multi-band dynamic range compressor. This process incurs unnecessary power consumption by the hearing instrument which shortens the battery life time.

SUMMARY

In view of the above outlined problems an improved multi-band signal processor, for example a multi-band dynamic range compressor, which allows separate and flexible update rates of the frequency bands of the analysis filter would be advantageous. Such an improved multi-band signal processor will provide much increased flexibility in selecting the block update rate of any particular frequency band of the analysis filter. Hence, allowing perceptual performance of the improved multi-band signal processor to be traded against computational resources in a flexible manner.

A first aspect of the present disclosure relates to a multi-band signal processor comprising a signal input for receipt of a digital audio input signal and a cascade of digital all-pass filters configured for receipt of the digital input audio signal and generation of M delayed digital audio signal samples at respective tapping nodes interposed between the digital all-pass filters. The multi-band signal processor comprises a signal convolution processor configured for convolving the M delayed digital audio signal samples with M time-varying filter coefficients of a processing filter to produce a processed digital output signal. A frequency domain transform processor is configured for converting the M delayed digital audio signal samples to frequency domain representation to produce respective signal spectrum values in a predetermined number of frequency bands, N. A level estimator is configured to compute respective signal level estimates in the predetermined number of frequency bands based on the respective signal spectrum values. A processing gain calculator of the multi-band signal processor is configured for computation of a frequency domain gain coefficient for each of the predetermined number of frequency bands based on the respective signal level estimates and band gain laws. An inverse frequency domain transform processor is configured for conversion of the N frequency domain gain coefficients into the M time-varying filter coefficients of the processing filter. The frequency domain transform processor is configured to compute signal spectrum values of at least two different frequency bands at different band update rates. Each of M and N is a positive integer number.

The frequency domain transform processor's capability to utilize differing band update rates in the at least two different frequency bands provides an advantageous flexibility in choosing individual update rates for two or more of the predetermined number of frequency bands. This feature allows the perceptual performance of the present multi-band signal processor to be traded against computational resources in a flexible manner. This feature also addresses and solves the above-discussed problems with the use of the same update rate for all frequency bands imposed by prior art FFT based processing. The same band update rate for all frequency bands means that an adequate band update rate of low frequency bands typically leads to a much higher update rate of the high frequency bands than necessary for adequate sampling. Likewise, if an adequate band update rate is selected for the low frequency bands, the high frequency bands will be under sampled leading to aliasing and erroneous level estimates in the high frequency bands. In contrast, the capability of the present frequency domain transform processor to apply individual band update rates for two or more of the predetermined number of frequency bands means that each frequency band can be supplied with an optimal band update rate to on one hand avoid aliasing distortion and the other hand avoid oversampling and waste of computational resources. The update rate of a particular band can also be optimized based on certain perceptual performance criteria of the multi-band signal processor such as speech intelligibility. In this manner, the band update rate may be relatively high in the frequency band or bands which have large impact on the perceptual performance criterion or criteria in question and the band update rate relatively low in frequency band or bands that have low impact on the perceptual performance criterion. Hence, computational resources of the frequency domain transform processor, level estimator and processing gain calculator may be allocated to those frequency bands that are important for the perceptual performance criteria.

The multi-band signal processor is preferably designed such that the number of delayed digital audio signal samples, M, is an even number between 8 and 64 for hearing instrument applications. This corresponds to M−1 digital all-pass filters. The predetermined number of frequency bands, N, is preferably selected such that N=(M/2)+1. In this embodiment, there exists a single frequency domain gain coefficient for each frequency band generated by the frequency domain transform processor. In other words, while there are a total of M time-varying filter coefficients to process the M delayed filter taps, only (M/2)+1 out of these M time-varying filter coefficients are unique. The residual (M/2)−1 time-varying filter coefficients are determined by the fact that an (inverse) Fourier Transform of a real-valued gain vector leads to a symmetric set of vector filter coefficients. The details of this transformation are described in U.S 2003/0081804.

The skilled person will appreciate that setting N=(M/2)+1 is particularly convenient if the frequency domain transform processor is configured to apply a Discrete Fourier Transform (DFT) to calculate the signal spectrum values in the frequency bands. However, the number of frequency bands, N, may be larger or smaller than (M/2)+1, for example N=M/2. Generally, when the frequency domain transform processor (analysis filter) and the inverse frequency domain transform processor (synthesis filter) are properly matched any number N<=M may be used depending on the requirements of a particular application of the present multi-band signal processor.

The signal convolution processor of the present multi-band signal processor may either be updated sample-by-sample or block updated. In the former case, the update rate of the signal convolution processor corresponds to the sampling rate of the digital audio input signal, i.e. the reciprocal of a sampling frequency. The sampling frequency will typically vary depending on characteristics of the particular type of processing implemented by the multi-band signal processor. The sampling frequency of the digital audio input signal preferably lies between 16 kHz and 48 kHz in hearing instrument applications of the multi-band signal processor. If the signal convolution processor is updated in blocks, each block may comprises a plurality of digital audio signal samples such as between 4 and 64 digital audio signal samples. The band update rate of a particular frequency band determines how often the signal spectrum value of that frequency band is calculated by the frequency domain transform processor. The maximum band update rate, which may apply to one frequency band or to a subset of frequency bands of the predetermined number of frequency bands, corresponds to the update rate of the signal convolution processor. This maximum band update rate may be the sample rate or the block rate of the signal convolution processor. When the signal spectrum value in the frequency band or in the subset of frequency bands is/are calculated or updated the corresponding signal level estimate(s) and frequency domain gain coefficient(s) are preferably also computed such that changes to the signal spectrum value or values are reflected in values of the M time-varying filter coefficients of the processing filter. On the other hand, in the residual frequency bands where the signal spectrum values are not calculated or updated for a particular update or time step of the signal convolution processor, the most recently computed signal spectrum values are maintained. This also means the corresponding signal level estimates and frequency domain gain coefficients preferably are maintained.

As mentioned previously, the band update rate is preferably adapted to the location of the frequency band such that low frequency bands generally have a lower band update rate than high frequency bands. The low frequency band or bands may for example have center frequencies between 100 Hz and 500 Hz while the high frequency bands may have center frequencies between 3 kHz and 8 kHz. Hence, one embodiment of the frequency domain transform processor is configured to computing the signal spectrum value of at least a first frequency band at a first band update rate and computing the signal the signal spectrum value of at least a second frequency band at lower update rate than the first band update rate, such as 0.5, 0.33 or 0.25 times the first band update rate. The center frequency of the first frequency band is higher than the center frequency of the second frequency band.

The skilled person will appreciate that the present multi-band signal processor may be adapted to perform a variety of signal processing functions of digital audio signals in numerous types of stationary and portable audio enabled equipment such as hearing instruments, head-sets, public address systems, smartphones, tablets etc. The present multi-band signal processor may be adapted to perform signal processing functions like multi-band dynamic range compression of the audio input signal, multi-band dynamic range expansion of the audio input signal, noise reduction of the audio input signal etc. by appropriate design of one or more of the band gain laws of the processing gain calculator.

For each update of the signal convolution processor, the frequency domain transform processor may be configured for updating the respective signal spectrum values of a subset of the predetermined number of frequency bands, the level estimator may be configured for updating respective signal level estimates of the subset of frequency bands, the processing gain calculator may be configured for updating respective frequency domain gain coefficients of the subset of frequency bands and for maintaining frequency domain gain coefficients of the residual frequency bands; and the inverse frequency domain transform processor may be configured for conversion of the updated and the maintained frequency domain gain coefficients into the M time-varying filter coefficients of the processing filter.

The skilled person will understand that the frequency domain transform processor may be configured to update the signal spectrum value of each frequency band of the predetermined number of predetermined number of frequency bands at a constant rate. This constant band update rate may be defined by a repetitive band update schedule as described below in more detail. Despite the constant band update rate of each frequency band, the band update rates may differ between all frequency bands or there may be several subsets of frequency bands with identical update rates. In another embodiment of the frequency domain transform processor the band update rate of each frequency band is independently adapted based on predicted need. The predicted need may be determined based on certain signal characteristics of the digital audio input signal such a predicted rate of change. Adaptive update rates may lead to further improvements in the computational load versus performance trade-off of the present multi-band signal processor.

As mentioned above, the frequency domain transform processor is preferably configured to updating the respective signal spectrum values in the predetermined number of frequency bands according to a predetermined repetitive band update schedule. The frequency domain transform processor may comprise a band selector which selects the particular frequency band or bands which are to be updated at each sample update or block update of the convolution processor. The band selector may therefore control in which order, and hence at which update rate (how often), the signal spectrum value in any particular frequency band is recomputed or updated in accordance with the band update schedule. The skilled person will understand that the update of the signal spectrum value in a particular band preferably is followed immediately by corresponding updates of the level estimate and frequency domain gain coefficient for the frequency band in question. The repetitive band update schedule may be designed in numerous ways for example by using a so-called schedule matrix as described below in additional detail with reference to the appended drawings. The skilled person will understand that the use of the repetitive band update schedule provides significant flexibility to the operation of the frequency domain transform processor with respect to how often any particular frequency band is updated, i.e. the band update rate, and the sequence in which the individual frequency bands are updated. These features may be exploited to optimize the update rate of certain frequency bands that are known to improve spectral coverage of the digital audio input signal, i.e. minimizing modulation or gaps in the time-frequency spectrum covered by the band responses.

Signal processing functions of the present multi-band signal processor may be performed by dedicated digital hardware or may be performed as one or more computer programs, routines and threads of execution running on a software programmable signal processor or processors. Each of the computer programs, routines and threads of execution may comprise a plurality of executable program instructions. Alternatively, the signal processing functions may be performed by a combination of dedicated digital hardware and computer programs, routines and threads of execution running on the software programmable signal processor or processors. For example each of the above-mentioned "frequency domain transform processor", "signal convolution processor", "inverse frequency domain transform processor", "processing gain calculator" and "level estimator" may comprise a computer program, program routine or thread of execution executable on a suitable microprocessor, in particular a Digital Signal Processor. The microprocessor and/or the dedicated digital hardware may be integrated on an ASIC or implemented on a FPGA device.

The frequency domain transform processor may be configured to compute the signal spectrum values of the M delayed digital audio signal samples is various ways without relying on the FFT algorithm. A preferred embodiment of the frequency domain transform processor uses the Discrete Fourier Transform to compute the signal spectrum value of a single frequency band by relying on vector times vector inner products. This embodiment of the frequency domain transform processor is configured to: compute the signal spectrum value of each of the frequency bands as an inner vector product between the M delayed digital audio signal samples and windowed or un-windowed Discrete Fourier Transform coefficients of a row of Discrete Fourier Transform matrix corresponding to the frequency band.

The inverse frequency domain transform processor may be configured to:

converting the updated and the maintained frequency domain gain coefficients into the M time-varying filter coefficients by executing a set of scalar-vector multiplications;

wherein the scalar comprises the updated or maintained frequency domain gain coefficient and the vector comprises one row or column of coefficients of an IFFT based synthesis matrix.

The particular signal processing function implemented by the present multi-band signal processor may be conveniently defined by controlling characteristics of the band gain laws. The band gain laws of the processing gain calculator may differ between different frequency bands. In one exemplary embodiment, all band gain laws may be configured to provide dynamic range compression of the respective signals in the frequency bands, but specific compression parameters such as compression ratio and time constants may vary between individual frequency bands. In one exemplary embodiment, the band gain laws may differ between different frequency bands such that a first subset of the predetermined number of frequency bands are configured to provide dynamic range compression and another subset of frequency bands provides dynamic range expansion or noise reduction etc.

Preferably, one or more of the band gain laws of the processing gain calculator are configured to provide one of:
multi-band dynamic range compression of the audio input signal,
multi-band dynamic range expansion of the audio input signal,
noise reduction of the audio input signal.

As used in this specification, the term "band gain law" or "band gain laws" refer to any function(s), relationship(s), equation(s), and/or algorithm(s) that is configured to provide certain feature(s) associated with the audio input signal. The band gain law(s) may be arbitrary defined in some embodiments.

A second aspect of present disclosure relates to a hearing instrument for use by a user. The hearing instrument comprises a first microphone for generation of a first microphone signal in response to receipt of sound,
an audio input channel coupled to the first microphone signal and configured to generate a corresponding digital audio input signal,
a multi-band signal processor according to any of the above-described embodiments thereof coupled or connected to the digital audio input signal. The multi-band signal processor is configured for receipt and processing of the first microphone signal according to a hearing loss of the user. The hearing instrument comprises a sound reproduction channel for receipt of the processed digital output signal of the multi-band signal processor and conversion into audible sound for transmission to the user.

A third aspect of the present disclosure relates to a method of processing a digital input audio signal to produce a processed digital output signal, comprising steps of:
a) all-pass filtering the digital input audio signal through a cascade of digital all-pass filters to generate M delayed digital audio signal samples,
b) converting the M delayed digital audio signal samples to frequency domain representation in a predetermined number of frequency bands, N, to compute respective signal spectrum values,
c) estimating respective signal levels in the predetermined number of frequency bands based on the signal spectrum values,
d) computing respective frequency domain gain coefficients for the predetermined number of frequency bands based on the respective signal level estimates and respective band gain laws,
e) transforming the frequency domain gain coefficients to time domain representation to produce M time-varying filter coefficients of a processing filter,
f) convolving the M delayed digital audio signal samples with the M time-varying filter coefficients of the processing filter to produce the processed digital output signal,
g) updating the M delayed digital audio signal samples in accordance with either a sample-by-sample rate or a predetermined block rate; wherein the signal spectrum values of at least two different frequency bands are updated at different rates and each of M and N is a positive integer number.

According to a preferred embodiment of the methodology of processing the digital input audio signal, after each sample update, or each block update, of the M delayed digital audio signal samples:
step b) comprises updating a subset of the predetermined number of frequency bands with respective signal spectrum values,
step c) comprises updating respective signal level estimates of the subset of frequency bands,
step d) comprises updating respective frequency domain gain coefficients of the subset of frequency bands and maintaining previous frequency domain gain coefficients of the residual frequency bands,
step e) comprises converting the updated and maintained frequency domain gain coefficients into updated values of the N time-varying filter coefficients of the processing filter.

The skilled person will understand that the subset of frequency bands may comprises a single frequency band only. In the latter embodiment, the signal spectrum value of a single frequency band is updated for each execution of step f) where the M delayed digital audio signal samples are convolved with the M time-varying filter coefficients of the processing filter. This is particularly advantageous when the convolution processor and runs in the previously discussed sample-by-sample mode because it allows certain frequency bands to have a high update rate by a suitable design of the previously discussed band update schedule.

Preferably, different subsets of frequency bands are updated between consecutive sample updates, or consecutive block updates, of the M delayed digital audio signal samples in accordance with a predetermined repetitive band update schedule.

A fourth aspect of the present disclosure relates to a computer readable data carrier comprising executable program instructions configured to cause a signal processor to execute method steps a)-g) of the above outlined method of processing a digital input audio signal to produce a processed digital output signal. The computer readable data carrier may comprise a magnetic disc, optical disc, memory stick or any other suitable data storage media.

A multi-band signal processor includes: a signal input for receipt of a digital audio input signal; a cascade of digital all-pass filters configured for receipt of the digital audio input signal and generation of M delayed digital audio signal samples at respective tapping nodes interposed between the digital all-pass filters; a signal convolution processor configured for convolving the M delayed digital audio signal samples with M time-varying filter coefficients of a processing filter to produce a processed digital output signal; a frequency domain transform processor configured for converting the M delayed digital audio signal samples to frequency domain representation to provide respective signal spectrum values in N number of frequency bands; a level estimator configured to compute respective signal level estimates in the N number of frequency bands based on the respective signal spectrum values; a processing gain calculator configured for computation of a frequency domain gain coefficient for each of the N number of frequency bands based on the respective signal level estimates and band gain laws; and an inverse frequency domain transform processor configured for conversion of the N frequency domain gain coefficients into the M time-varying filter coefficients of the processing filter; wherein the frequency domain transform processor is configured to provide at least two of the signal spectrum values of at least two of the frequency bands at different band update rates; and wherein M is a positive integer number, and N is a positive integer number.

Optionally, the signal convolution processor is configured to be updated either sample-by-sample or updated in blocks where each block comprises a plurality of digital audio signal samples.

Optionally, the frequency domain transform processor is configured to: compute one of the signal spectrum values for a first frequency band of the N number of frequency bands at a first band update rate, compute another one of the signal spectrum values for a second frequency band of the N number of frequency bands at lower update rate than the first band update rate; wherein a center frequency of the first frequency band is higher than a center frequency of the second frequency band.

Optionally, the signal convolution processor is configured to be updated in a number of updates, and wherein for each of the updates: the frequency domain transform processor is configured to update a subset of the signal spectrum values for a subset of the N number of frequency bands; the level estimator is configured to update a subset of the signal level estimates for the subset of the N number of frequency bands; and the processing gain calculator is configured to update a subset of the frequency domain gain coefficients for the subset of the N number of frequency bands, and maintain a remaining of the frequency domain gain coefficients for a remaining of the N number of frequency bands.

Optionally, the subset of frequency bands is formed by a single frequency band of the N number of frequency bands.

Optionally, the inverse frequency domain transform processor is configured to: convert the updated frequency domain gain coefficients and the maintained frequency domain gain coefficients into the M time-varying filter coefficients by executing a set of scalar-vector multiplications; wherein a scalar involved in the scalar-vector multiplications comprises the updated frequency domain gain coefficients or the maintained frequency domain gain coefficient, and a vector involved in the scalar-vector multiplications comprises one row or column of coefficients of an IFFT based synthesis matrix.

Optionally, the frequency domain transform processor is configured to update the signal spectrum values for the respective frequency bands at a constant update rate.

Optionally, the frequency domain transform processor is configured to updating the signal spectrum values according to a predetermined repetitive band update schedule.

Optionally, the frequency domain transform processor is configured to compute at least one of the signal spectrum values as an inner vector product between the M delayed digital audio signal samples and windowed or un-windowed Discrete Fourier Transform coefficients of a row of a Discrete Fourier Transform matrix.

Optionally, one or more of the band gain laws are configured to provide a multi-band dynamic range compression of the digital audio input signal, a multi-band dynamic range expansion of the digital audio input signal, or a noise reduction of the digital audio input signal.

A hearing instrument for use by a user, the hearing instrument comprising: the multi-band signal processor; a first microphone coupled to the multi-band signal processor; and a speaker coupled to the multi-band signal processor.

A method of processing a digital audio input signal to produce a processed digital output signal, includes: all-pass filtering the digital audio input signal through a cascade of digital all-pass filters to generate M delayed digital audio signal samples; converting the M delayed digital audio signal samples to frequency domain representation in N number of frequency bands to compute respective signal spectrum values; determining respective signal level estimates in the N number of frequency bands based on the signal spectrum values; computing respective frequency domain gain coefficients for the N number of frequency bands based on the respective signal level estimates and band gain laws; transforming the frequency domain gain coefficients to time domain representation to produce M time-varying filter coefficients of a processing filter; convolving the M delayed digital audio signal samples with the M time-varying filter coefficients of the processing filter to produce the processed digital output signal; and updating the M delayed digital audio signal samples in accordance with a sample-by-sample rate or a predetermined block rate; wherein at least two of the signal spectrum values for at least two of the N number of frequency bands are updated at different rates; and wherein M is a positive integer number, and N is a positive integer number.

Optionally, the method further includes: updating a subset of the signal spectrum values for a subset of the N number of frequency bands; updating a subset of the signal level estimates for the subset of the N number of frequency bands; updating a subset of the frequency domain gain coefficients for the subset of the N number of frequency bands; and maintaining a remaining of the frequency domain gain coefficients for a remaining of the N number of frequency bands.

Optionally, the M delayed digital audio signal samples are updated in accordance with a predetermined repetitive band update schedule.

A computer product comprising a non-transitory medium storing executable program instructions, an execution of which by a signal processor will cause any of the previous methods to be performed.

Other and further aspects and features will be evident from reading the following detailed description of the embodiments.

BRIEF DESCRIPTION OF THE DRAWINGS

Embodiments will be described in more detail in connection with the appended drawings in which.

DESCRIPTION OF PREFERRED EMBODIMENTS

Figure 1:
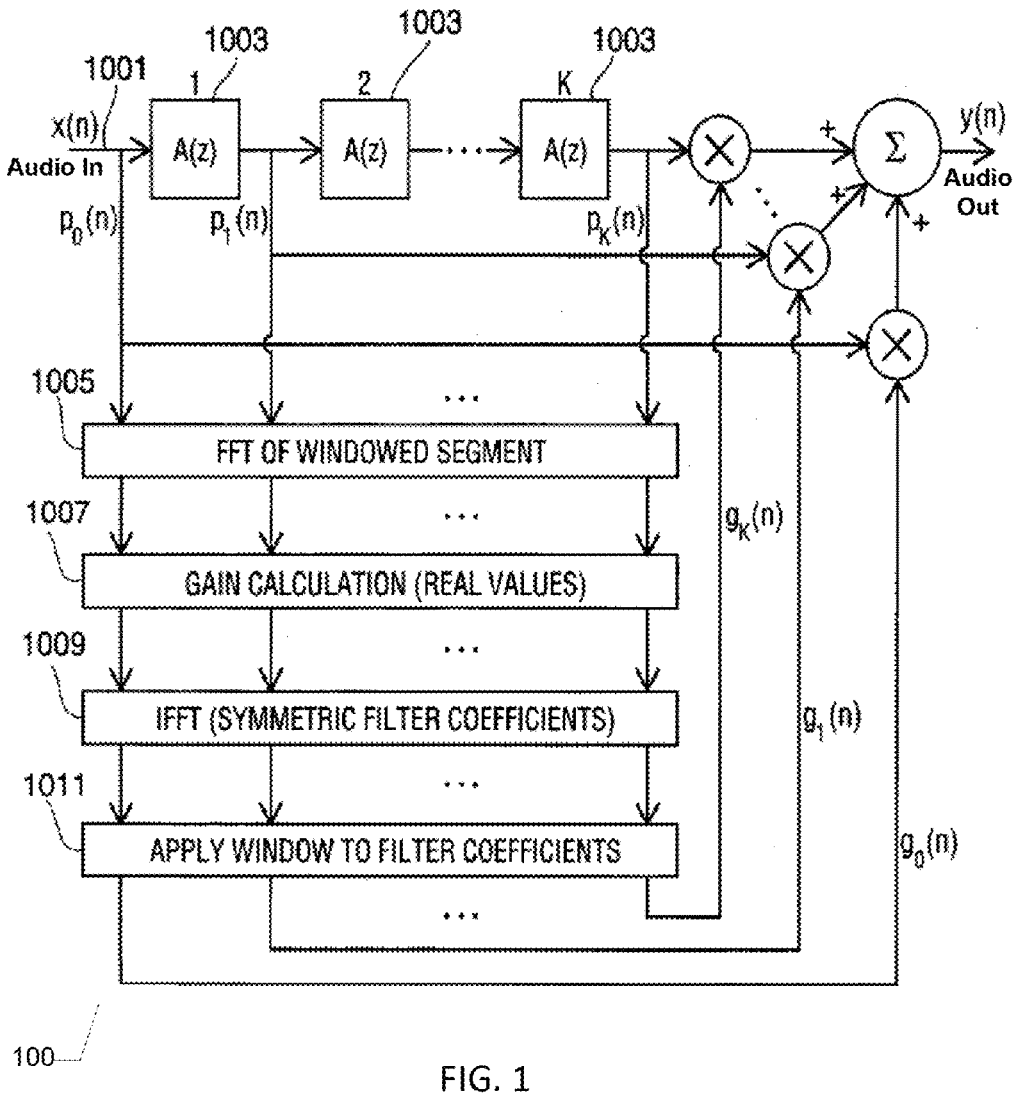
FIG. 1 is a schematic block diagram of a prior art Fast Fourier Transform (FFT) based multi-band dynamic range compressor with a side-branch architecture.

Various embodiments are described hereinafter with reference to the figures. It should be noted that the figures are not necessarily drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

FIG. 1 is a schematic block diagram of a prior art Fast Fourier Transform (FFT) based multi-band dynamic range compressor 100 with a so-called side-branch architecture. The multi-band dynamic range compressor 100 uses a side branch to make frequency analysis, compression gain coefficient calculation and frequency synthesis of the audio input signal. A digital audio input signal x(n) is applied at an input 1001 of the multi-band dynamic range compressor 100 and propagates through a cascade of K first-order all-pass filters A(z) to produce a sequence of delayed digital audio signal samples $p_0(n)$-$p_K(n)$. The use of the first order all-pass filters, rather than traditional pure delays, transforms the frequency scale on which the frequency analysis and frequency synthesis is carried out to a so-called warped frequency scale with numerous desirable properties as discussed previously. The sequence of delayed samples $p_0(n)$-$p_K(n)$ is then windowed and a FFT calculated using the windowed sequence 1005. The result of the FFT is a frequency spectrum sampled at a constant spacing on a Bark frequency scale. Since the input data sequence is windowed, the frequency spectrum is smoothed in the warped frequency domain thereby producing overlapping frequency bands. The frequency domain level estimates (e.g., power spectrum) is computed from the warped FFT and the frequency domain gain coefficients (e.g., compression gains) then computed from the warped power spectrum for the auditory analysis bands 1007. As the frequency domain gain coefficients are pure real numbers, the inverse FFT of the warped time-domain filter results in a set of filter coefficients that is real and has even symmetry 1009. The system audio output y(n) is then calculated by convolving the sequence of delayed digital audio signal samples $p_0(n)$-$p_K(n)$ with the compression gain filter 1011 where $g_K(n)$ are the compression filter coefficients. The FFT operation 1005, which is running at the predetermined block rate, e.g. 1.5 milliseconds for 24 samples per block at 16 kHz sampling frequency, leads to a synchronous update of the power spectrum in all of the frequency bands and hence the same update rate of all frequency bands leading to the previously discussed problems.

Figure 2:
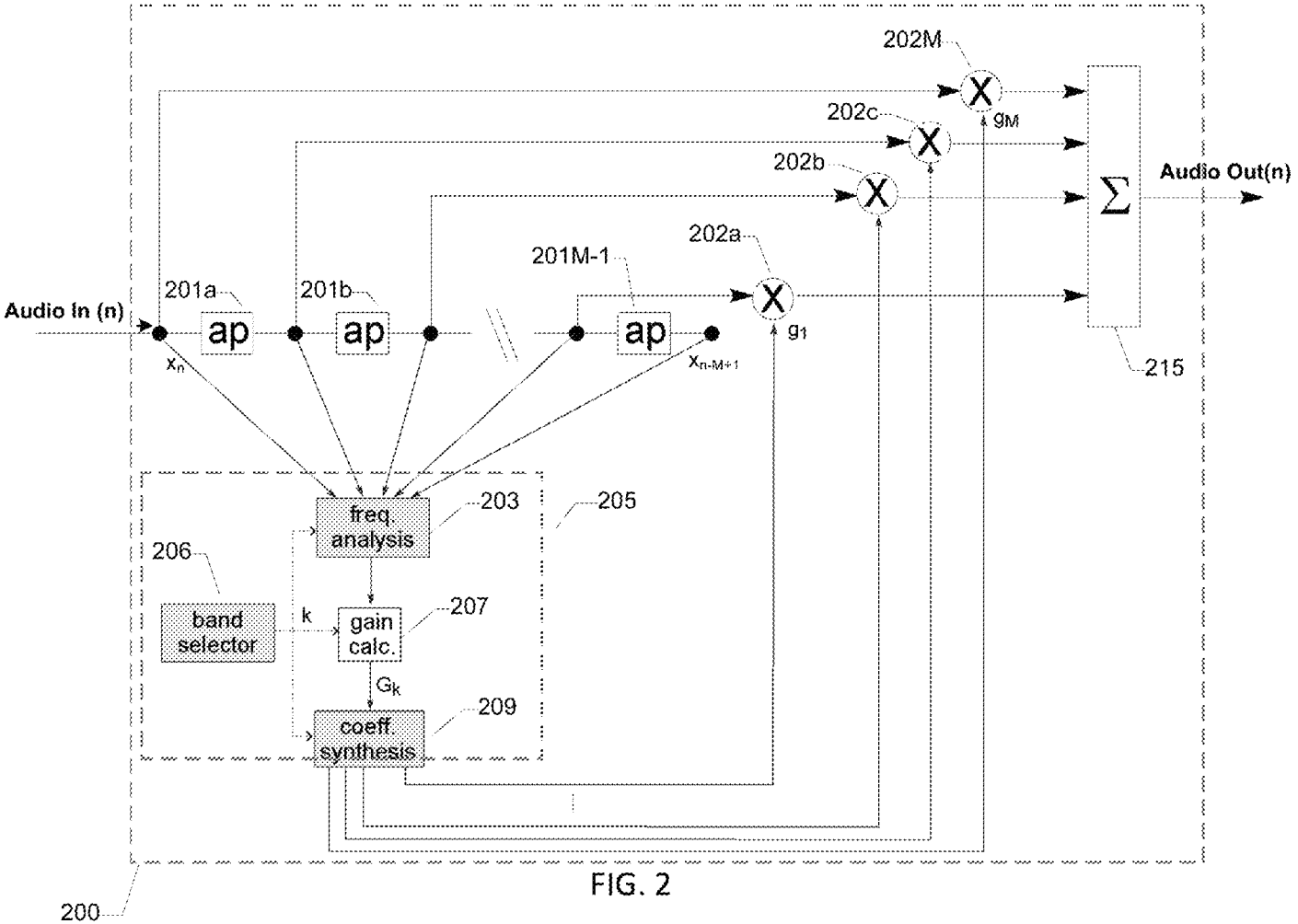
FIG. 2 shows a simplified schematic block diagram of a multi-band dynamic range compressor in accordance with some embodiments.

FIG. 2 is a simplified schematic block diagram of a multi-band signal processor 200 in accordance with some embodiments. In this embodiment, the multi-band signal processor is configured to function as a multi-band dynamic range compressor 200, but the skilled person will appreciate that other signal processing functions such as multi-band expansion or noise reduction may be implemented in other embodiments of the multi-band signal processor by appropriate adaptation.

The multi-band dynamic range compressor 200 comprises a signal input, Audio in, for receipt of a digital audio input signal to the compressor 200. A direct audio signal path through the compressor 200 comprises a cascade of M—1 digital all-pass filters 201*a*, 201*b*, . . . 201M−1 that receives the digital input audio signal generates a plurality of delayed digital audio signal samples at respective tapping nodes (black dots) interposed between the digital all-pass filters. The number of digital all-pass filters 201*a*, 201*b*, . . . 201M−1 of the cascade will vary depending on performance and power requirements of the particular application of the compressor 200. In a number of useful embodiments for multi-band compression in hearing instrument applications, the number of digital all-pass filters, M−1, may lie between 7 and 63 to generate between 8 and 64, respectively, delayed digital audio signal samples at the tapping nodes.

The direct audio signal path further comprises a signal convolution processor comprising a summation function 215 coupled to M outputs of M multipliers 202*a* . . . 202M. The signal convolution processor is configured for convolving consecutive samples, or blocks of samples, of the plurality of delayed digital audio signal samples with M time-varying compression filter coefficients $g_1$-$g_M$ of a compression filter at a predetermined update rate to produce a processed digital output signal at a digital audio output, Audio Out (n), of the multi-band compressor 200. N is a positive integer number and is preferably equal to, or smaller than, M. The skilled person will understand that the update rate may vary depending on whether the processing of the multi-band compressor 200 is block based or sample-by-sample based. In the block based embodiment of the multi-band compressor 200, a block of samples may contain all, or any subset, of the M delayed digital audio signal samples held at the tapping nodes. The sample-by-sample update rate of the multi-band compressor 200 allows the latter to respond particularly rapidly to impulsive noise, or other unwanted transients, in the digital audio input signal and thereby minimize user discomfort. The skilled person will understand that. the tapping nodes 202*k* for k=1, 2, . . . M execute the multiplication x_k(n)*g_k(n) where '*' refers to multiplication, x_k(n) is the signal at the k'th tap of the delay line, i.e. the cascade of digital all-pass filters, at time n and g k(n) is the kth time-varying compression filter coefficient at time n. The summation node 215 simply sums its inputs and transmits the result to the output, Audio Out(n). The signal convolution processor performs the calculation:

$$\text{Audio Out}(n)=\text{sum_}k[x_k(n)*g_k(n)],\ \text{where sum_}k \text{ refers to a sum over } k=1 \text{ through } M.$$

The multi-band compressor 200 further comprises a so-called side chain processor or function 205 comprising a frequency domain transform processor 203 (often designated "analysis filter bank"), an inverse frequency domain transform processor 209 (often designated "synthesis filter bank") and a processing gain calculator 207 interposed between the two former transform processors 203, 209. The side chain processor or function 205 finally comprises a band selector 206 which controls in which order, and hence how often, the signal spectrum value, and the accompanying frequency domain gain coefficient, in any particular frequency band of the plurality of individual frequency bands is calculated or updated as explain in further detail below with reference to FIG. 3. The output of the side chain processor 205 is the previously discussed N time-varying compression filter coefficients, or compression vector, $g_1$-$g_M$. The M delayed digital audio signal samples are applied to the inputs of the frequency domain transform processor 203 which converts the delayed digital audio signal samples to frequency domain representation to produce a signal spectrum value in each of the predetermined number of frequency bands created by the transform process. The number of frequency bands may correspond to M/2+1 such that setting M=32 correspond to 17 frequency bands. These frequency bands are preferably overlapping with an overlap controlled by a window function for example a Hanning window.

The frequency domain transform processor 203, or alternatively the processing gain calculator 207, comprises a level estimator (not shown on FIG. 2 but shown as item 313 of FIG. 3) which is configured to compute a signal level estimate for each of the frequency bands based on the determined signal spectrum value in the frequency band in question. The signal level estimate may for example comprise an amplitude, power or energy level estimate. The level estimate in each frequency may also include certain time constants such as an attack time and a release time. The band gain law may for example define a certain compression ratio of audio signals within the frequency band in question. The compression ratio may be constant across all levels of the digital audio input signal or variable over the dynamic range of the digital audio input signal. The band gain law may be defined in various manners. In one embodiment the band gain law may be defined through a look-up table mapping values of the signal level estimate to corresponding values of the frequency domain gain coefficients $G_k$. The band gain law may differ between different frequency bands or be the essentially identical in two or more frequency bands. It is, however, often advantageous to use different band gain laws, and thereby often different compression parameters, in at least two different frequency bands to make the most optimal hearing loss compensation of the hearing impaired user's hearing loss.

The computed frequency domain gain coefficients $G_k$ are passed to the inverse frequency domain transform processor 209 which is configured to convert the frequency domain gain coefficients into the M time-varying compression filter coefficients $g_1$-$g_M$ of the compression gain filter by coefficient synthesis as described below.

As mentioned above, the band selector 206 controls in which order, and hence how often, the signal spectrum value in any particular frequency band of the plurality of individual frequency bands is calculated or updated. Preferably, the band update rates of the signal spectrum values of at least two different frequency bands are different. The band update rate of a low frequency band, for example centered at 200 Hz, may for example generally be lower than the band update rate of a high frequency band, for example centered around 5 kHz, such that more computing resources are directed to accurately estimating the signal level in the high frequency band or bands. This is advantageous because the level of incoming sound can be expected to change more rapidly, for example caused by the previously discussed impulsive noise. The band update rate of the high frequency band may for example be equal to the block rate or the sample-by-sample update rate of the convolution processor of the multi-band compressor 200. The sample-by-sample update rate corresponds to the reciprocal of the selected sampling frequency of the digital audio input signal. This sampling frequency may be between 16 kHz and 48 kHz for typical hearing instrument applications. A block of samples may comprise between 4 and 64 samples. The update rate of the low frequency band may on the other hand correspond to every second, third, fourth etc. sample or every second, third, fourth etc. block of samples such that the update rate of the low frequency band becomes at least 2 times smaller than update rate of the high frequency band. This difference in update band rates between different frequency bands is in contrast to the previously discussed prior art Fast Fourier Transform (FFT) based multi-band dynamic range compressor 100 wherein the update rate of the power spectrum in all frequency bands is the same due to the FFT based block processing.

Figure 3:
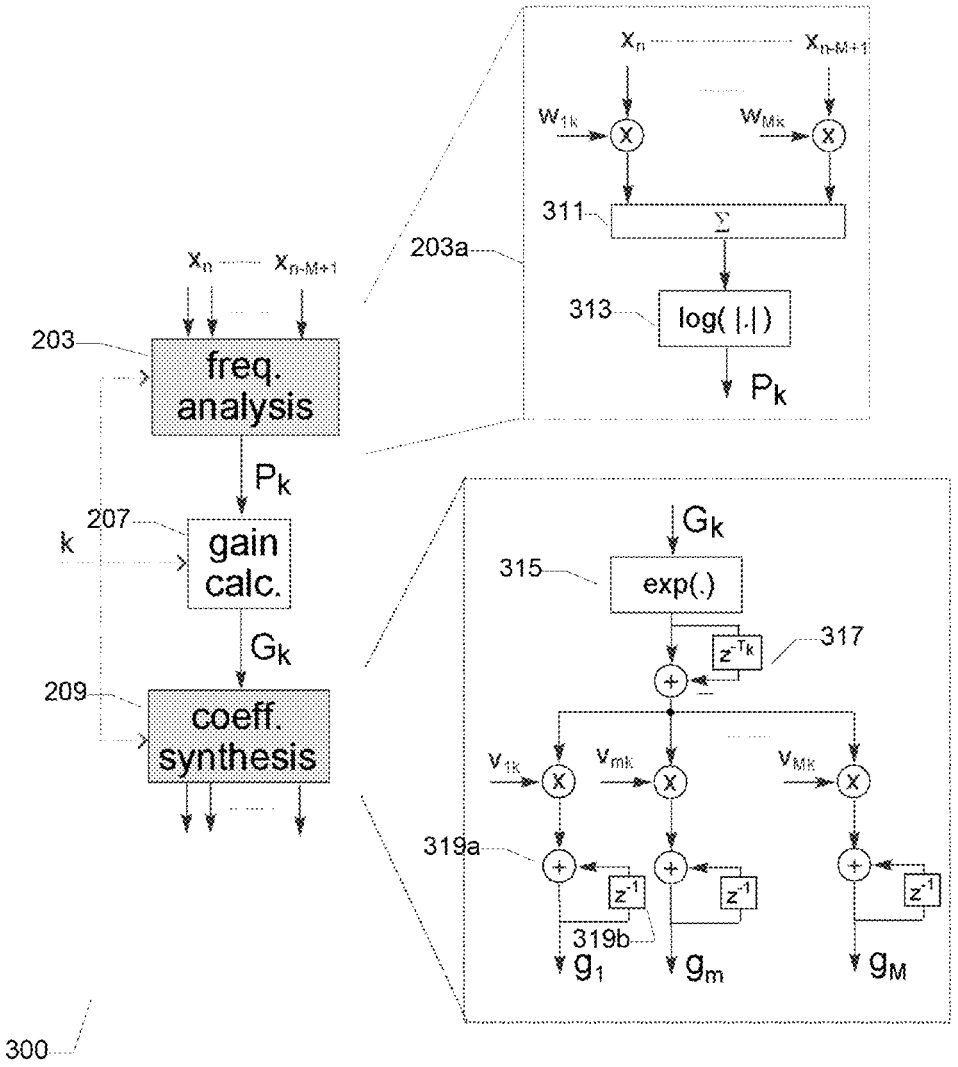
FIG. 3 is a schematic block diagram illustrating computation of a set of time-varying compression filter coefficients of a compression filter of the multi-band dynamic range compressor of FIG. 2, FIG. 4A) illustrates a first exemplary band update schedule based on a matrix filling methodology for the multi-band dynamic range compressor of FIG. 2, FIG. 4B) illustrates a second exemplary band update schedule for the multi-band dynamic range compressor of FIG. 2 comprising a repetitive pattern of frequency bands.

FIG. 3 is a schematic block diagram 300 illustrating in further detail how the previously discussed M time-varying compression filter coefficients $g_1$-$g_M$ are computed in the side-chain function 205 or branch of the multi-band compressor 200 of FIG. 2. The M delayed digital audio signal samples $x_n$-$x_{n-M+1}$ are applied to the inputs of the respective multipliers of the frequency domain transform processor 203. The transformation to the frequency domain representation is carried out by a Short Time Fourier Transform (STFT) algorithm in the present embodiment wherein weighting of STFT coefficients results from windowing by an appropriate window function, e.g. a Hanning window. The computation takes advantage of the property that the product between the M delayed digital audio signal samples $x_n$-$x_{n-M+1}$ and the SFTF coefficient matrix, which is a matrix-vector product, can be executed as a sequence of vector-vector products. More specifically, the inner product between the M coefficients of the $k^{th}$ row of STFT coefficients, illustrated by $W_{1k}$-$W_{Mk}$ in the detailed flow chart 203*a*, of the STFT matrix and the M delayed digital audio signal samples determines the updated signal spectrum value in the $k^{th}$ frequency band of the analysis filter 203. The updated signal spectrum value of the $k^{th}$ frequency band appears at the output of a summation function 311. A signal level estimate $P_k$ of the signal spectrum value in the $k^{th}$ frequency band is determined in a power estimation function 313 where a logarithmic power estimate is formed by squaring the signal spectrum value and taking the logarithm of the result. The signal level estimate $P_k$ is applied to the previously discussed processing gain calculator 207 which computes the corresponding updated value of the frequency domain gain coefficient $G_k$ based on the previously discussed band gain law of the $k^{th}$ frequency band. On the other hand, the previous value of each of the frequency domain gain coefficients of the residual N−1 frequency bands that remains unprocessed or updated in the current sample period is maintained by suitable memory elements (not shown) of the side chain processor or function 205. The inner vector product between STFT coefficients and the M delayed digital audio signal samples is carried out for each one of a pre-selected set of STFT vectors each comprising a specific row of STFT coefficients, for example $W_{19}$-$W_{M9}$ and $W_{13}$-$W_{M3}$ etc. corresponding to the $9^{th}$ frequency band and $13^{th}$ frequency band, respectively, etc. In this manner, the signal spectrum value in each frequency band is computed in a predetermined order or sequence controlled by the band selector 206. The order or sequence defines a predetermined band update or band sampling schedule which determines in which order and how often the signal spectrum value of any particular frequency band is calculated or updated.

Figure 4:
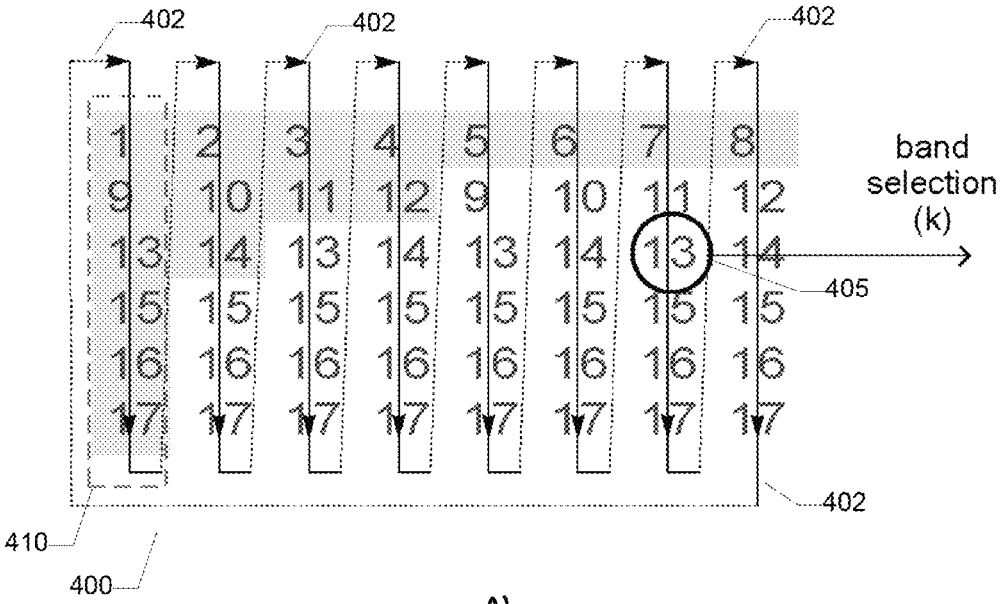
Figure 4:
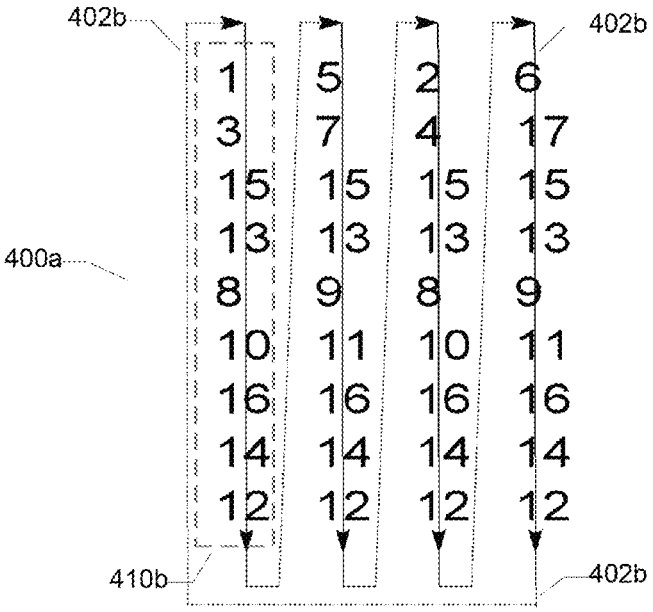

An exemplary band update or sampling schedule 400 is illustrated in FIG. 4A) for the above-described multi-band compressor 200 in an embodiment with M=32 and 17 different frequency bands. Furthermore, in the present embodiment, the signal convolution processor is updated at a sample-by-sample rate and the characteristics of the exemplary band sampling schedule 400 adapted to this sample-by-sample update rate. The skilled person will understand that the signal convolution processor in alternative embodiments may be updated at a suitable block rate and the band update schedule adapted thereto.

The band sampling schedule 400 is laid-out as a schedule matrix 400 which comprises 8 columns and 6 rows of integer numbers which are frequency band indices defining a particular frequency band of the 17 different frequency bands. At each sample update of the signal convolution processor of the multi-band compressor, a single frequency band only is processed and updated. The number of the frequency band to be updated or processed at any particular sample time is indicated by a "band update schedule". Now consider the column wise trajectory through the schedule matrix 400 as indicated by the closed-loop schedule curve 402. This trajectory defines the band update schedule. At each sample period the band selector 206 proceeds to the next entry in the band update schedule and thereby selects the frequency band to be updated or processed. The direction of the closed-loop schedule curve 402 hence shows in which direction and order the frequency bands are updated/sampled and their respective level estimates and accompanying frequency domain gain coefficients updated. For instance, if at sample time step n the closed-loop schedule curve 402 is located at matrix entry (3,7), then the selected frequency band is number 13, as indicated by circle 405 of the schedule matrix 400. At the subsequent sample time step (n+1), the closed-loop schedule curve will be at matrix entry (4, 7) and the frequency band number 15 will be updated.

The closed nature of the closed-loop schedule curve 402 means that the band update or sampling schedule is repeated after every 6*8=48 sample periods or time steps. Note that, by construction, the matrix filling method ensures that the number of sample time periods or steps between selection and update of the same frequency band, i.e. the band update rate or band sampling period, remains constant for each frequency band. For instance, the band update rate for frequency band 4 is 48 sample periods corresponding to a complete tour through the schedule matrix 400. For a 16 kHz sampling frequency of the digital audio input signal, this corresponds to a band update rate of approximately 3 ms. For frequency band 9, the band update rate is 24 sample periods and for frequency band 16 the band update rate is 6 sample periods which correspond to approximately 1.5 ms and 0.375 ms, respectively.

Hence, the band updates rates of frequency bands 4, 9 and 16 all differ in this particular embodiment thereof. In other words, the distinguishing feature of creating a valid band update schedule by using the schedule matrix 400 methodology is that by construction the band update rate is constant, possibly unique, for any given band number. The update for any particular frequency band can be increased if the band selector 206 is configured to repeat the pattern more often when "filling" the schedule matrix 400. The skilled person will understand that a band update schedule may be constructed in numerous ways and may be adapted to application specific performance requirements. A band schedule may for example be constructed such that each frequency band has its own unique update rate/sampling period, i.e. two frequency bands are never scheduled at the same time the update rate of each frequency band remains constant. One way of constructing the band schedule by the "matrix filling method" is illustrated by the schedule matrix 400. On the first row, the numbers 1 through 8 is placed. On the second row, the numbers 9 through 12; on the third row, the numbers 13 and 14 and the fourth through sixth rows hold the numbers 15 through 17. The matrix entries that have been filled are shaded with grey background. Row 1 has been filled completely, but rows 2 through six are only partially filled. Now the open positions of each of the rows may be filled by repeating the initial number patterns in each row. For instance, row 3 now defines frequency bands 13 14 13 14 13 14 13 14, i.e. four times repeating the pattern 13 14. The schedule matrix 400 is now filled with (multiples of) the frequency band indices 1 through 17.

The skilled person will appreciate that many variations over the matrix filling method described above are possible. For instance, one could fill a matrix of different size with the numbers 1 through 17 which would result in a different band update schedule. Alternatively, for a filter bank with 17 frequency bands, one could fill a matrix with more than 17 numbers, e.g. the numbers 1 through 20. Each time a frequency band number greater than 17 is selected none of the available frequency band will be updated or processed. This scheme would lead to a filter bank where at each sample time period either a single band or no frequency band is processed. Such a band update schedule is advantageous because it allows battery consumption to be traded off against perceptual performance of the multi-band compressor. In the same vein, the schedule matrix 400 could also describe a possible band update schedule for any filter bank with less than 17 frequency bands. Finally, one could make permutations to the band schedule matrix 400, e.g., exchanging the frequency band numbers 8 and 14 in the band schedule matrix 400 leads to a different, but valid band update schedule. Further ad hoc modifications to the band schedule matrix 400 that result in valid schedules are possible. An important reason for permuting the band update schedule is to improve spectral coverage, i.e. minimizing modulation or gaps in the time-frequency spectrum covered by the band responses. An example of an optimized spectral coverage of the band sampling schedule is shown in the time-frequency plot of FIG. 5 with the corresponding (9×4) schedule matrix 400*a* shown on FIG. 4B).

It is furthermore evident that the exemplary band sampling schedule 400 defines a lower band update rate for at least several low frequency bands such as bands 1, 2, 3, 4 and 5 than for the high frequency bands such as bands 14, 15 and 16. It is also evident that the unconstrained design space for the band sampling schedule provides much increased flexibility regarding when to update the signal spectrum value, and the corresponding level estimate and frequency domain gain coefficient, for a particular frequency band. Hence, for the same perceptual performance as the previously discussed prior art FFT based multi-band dynamic range compressor 100, it is possible to reduce the computational load by a significant amount through individual band update rates of the frequency bands. In an advanced mode, the band update rate of each the frequency bands may be independently adapted based on predicted need.

The compression gain filter is preferably updated when the selected frequency band is updated in accordance with the band sampling schedule such that updated values of all of the M time-varying compression filter coefficients $g_1$-$g_M$ are computed for each sample time period. To apply the compression gain filter in the time domain, i.e. determining the updated values of the M time-varying compression filter coefficients $g_1$-$g_M$ reflecting the updated value of the frequency domain gain coefficient $G_k$ of the k'th band, the needs to be transformed back to the time domain. There are in principle at least two different ways this can be carried out: (1) perform an IFFT on the frequency domain gain coefficients $G_k$ and multiply element-wise with an appropriate synthesis window, or (2) proceed as illustrated in the detailed flow diagram 209*a* of the inverse frequency domain transform processor 209 and use a matrix-vector multiplication in which the matrix directly combines appropriate IFFT basis vectors with an appropriate synthesis window. Using the latter methodology, and taking into account that only one frequency band is updated per sample time period, the compression filter coefficients $g_1$-$g_M$, or coefficient vector, are incrementally updated by scalar-vector multiplications where the scalar is the frequency domain gain coefficient in question, i.e. $G_k$ for the k'th frequency band and so on, and the vector is one row or column of coefficients from the IFFT based synthesis matrix. To proceed in this manner, the frequency domain gain coefficient $G_k$ is initially subjected to exponentiation function 315 to convert $G_k$ from the logarithm domain (created by logarithmic function 313) to a linear representation. In a subsequent step, the previous value of the frequency domain gain coefficient $G_k$ for the selected k'th frequency band is subtracted from the current value of $G_k$ by subtractor 317 leading to the update or increment of the value of the frequency domain gain coefficient $G_k$. Next, the increment of the value of the frequency domain gain coefficient is multiplied by weighted inverse Fourier coefficients from the IFFT based synthesis matrix indicated as coefficients $V_{1k}$-$V_{Mk}$ on the detailed flow diagram 209*a*. This step transforms the computed increment in the value of the frequency domain gain coefficient into corresponding increments or updates of each of the compression filter coefficients $g_1$-$g_M$. The increment or update of the compression filter coefficients $g_1$-$g_M$ corresponds to the update of the frequency domain gain coefficient of the k'th frequency band. These filter coefficient increments are added to respective ones of the previous filter coefficients by the memory/delay and add functions 319*a*, 319*b* connected to each of the compression filter coefficients $g_1$-$g_M$. Hence, updating the values of the compression filter coefficients $g_1$-$g_M$. The skilled person will appreciate that execution of the latter conversion in fixed-point arithmetic may lead to accumulation of rounding errors. Therefore, it is preferred to substitute the above outlined synthesis scheme once in a while by a full band inverse discrete Fourier transform. The latter resets or eliminates any accumulated rounding errors.

Figure 5:
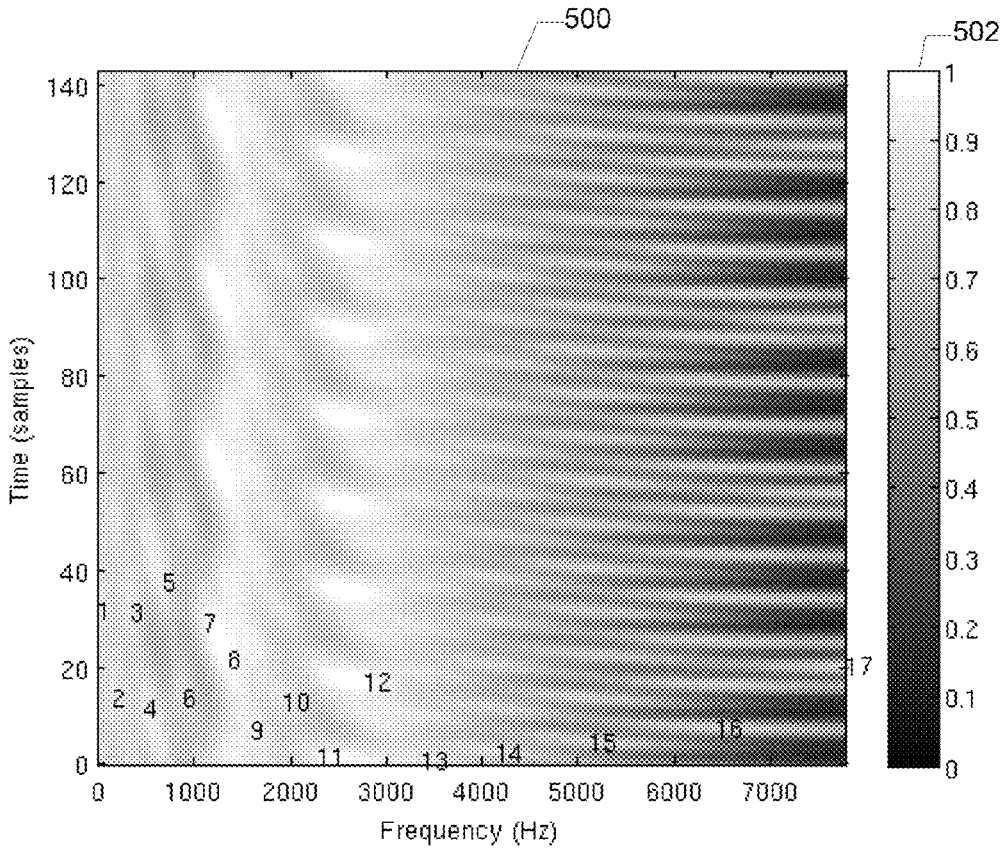
FIG. 5 shows a time-frequency plot of a processed output signal of the multi-band dynamic range compressor using the band update schedule shown on FIG. 4B) to optimize spectral coverage.

FIG. 5 is a time-frequency plot 500 which illustrates the optimized spectral coverage achieved by adopting the schedule matrix 400*a* shown on FIG. 4B) in the 17 band version of the multi-band compressor 200. The frequency axis is linear from 0 Hz to 8000 Hz which corresponding to the Nyquist frequency of the utilized 16 kHz sampling rate of the audio input signal to the multi-band compressor 200. The y-axis depicts time in samples of the audio signal such that 100 samples corresponds to about 6.25 ms. The grey scale on the time-frequency plot indicates relative the spectral coverage of the filterbank. A white/light colour (corresponding to about 1.0 on scale 502) at a given time-frequency coordinate in the plot indicates that the filterbank is capable of resolving that time-frequency location in the spectrum very well. In this context, "resolving well" means that any audio input signal at the spectral location in question is appropriately measured or detected by the spectral power estimates Pk. A black colour (corresponding to about 0.0-0.2) on scale 502) on the other hand indicates that any audio input signal at that time-frequency location would remain largely undetected by the band power estimation process performed in the side-chain processor of the multi-band compressor. The position of each of the 17 frequency bands on the time-frequency plot is indicated by the corresponding band indices. It is evident that the selected band sampling schedule as defined by the schedule matrix 400*a* leads to good spectral coverage across the important frequency range between about 100 Hz and 4 kHz for speech intelligibility. This is illustrated by the relatively white or light grey colour over time of the frequency bands 1-13. The resolution for frequency bands 14 through 17 is smaller or worse, but these frequency bands are less important for speech intelligibility. It's up to the designer of the band sampling schedule to decide if the spectral coverage characteristics match the application at hand. By changing the band sampling schedule, the designer can affect the properties of the spectral coverage pattern is a very direct manner and highly flexible manner as previously explained.

Although particular embodiments have been shown and described, it will be understood that it is not intended to limit the claimed inventions to the preferred embodiments, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

Items:

1. A multi-band signal processor comprising:
a signal input for receipt of a digital audio input signal,
a cascade of digital all-pass filters configured for receipt of the digital input audio signal and generation of M delayed digital audio signal samples at respective tapping nodes interposed between the digital all-pass filters, a signal convolution processor configured for convolving the M delayed digital audio signal samples with M time-varying filter coefficients of a processing filter to produce a processed digital output signal,
a frequency domain transform processor configured for converting the M delayed digital audio signal samples to frequency domain representation to produce respective signal spectrum values in a predetermined number of frequency bands, N,
a level estimator configured to compute respective signal level estimates in the predetermined number of frequency bands based on the respective signal spectrum values,
a processing gain calculator configured for computation of a frequency domain gain coefficient for each of the predetermined number of frequency bands based on the respective signal level estimates and band gain laws, an inverse frequency domain transform processor configured for conversion of the N frequency domain gain coefficients into the M time-varying filter coefficients of the processing filter;
wherein the frequency domain transform processor is configured to compute signal spectrum values of at least two different frequency bands at different band update rates;
wherein each of M and N is a positive integer number.

2. A multi-band signal processor according to item 1, wherein signal convolution processor is updated either sample-by-sample or updated in blocks where each block comprises a plurality of digital audio signal samples.

3. A multi-band signal processor according to item 1 or 2, wherein the frequency domain transform processor is configured to: computing the signal spectrum value of at least a first frequency band at a first band update rate,
computing the signal spectrum value of at least a second frequency band at lower update rate than the first band update rate;
wherein a center frequency of the first frequency band is higher than a center frequency of the second frequency band.

4. A multi-band signal processor according to item 2, wherein for each update of the signal convolution processor:
the frequency domain transform processor is configured for updating the respective signal spectrum values of a subset of the predetermined number of frequency bands,
the level estimator is configured for updating respective signal level estimates of the subset of frequency bands,
the processing gain calculator is configured for updating respective frequency domain gain coefficients of the subset of frequency bands and for maintaining frequency domain gain coefficients of the residual frequency bands,
the inverse frequency domain transform processor is configured for conversion of the updated and the maintained frequency domain gain coefficients into the M time-varying filter coefficients of the processing filter.

5. A multi-band signal processor according to item 4, wherein the subset of frequency bands is formed by a single frequency band of the predetermined number of frequency bands.

6. A multi-band signal processor according to any of the preceding items, wherein the frequency domain transform processor is configured to update the signal spectrum value of each frequency band at a constant update rate.

7. A multi-band signal processor according to item 6, wherein the frequency domain transform processor is configured to updating the respective signal spectrum values in the predetermined number of frequency bands according to a predetermined repetitive band update schedule.

8. A multi-band signal processor according to any of the preceding items, wherein the frequency domain transform processor is configured to:

compute the signal spectrum value of each of the frequency bands as an inner vector product between the M delayed digital audio signal samples and windowed or un-windowed Discrete Fourier Transform coefficients of a row of the Discrete Fourier Transform matrix corresponding to the frequency band.

9. A multi-band signal processor according to item 4, wherein the inverse frequency domain transform processor is configured to:

converting the updated and the maintained frequency domain gain coefficients into the M time-varying filter coefficients by executing a set of scalar-vector multiplications;

wherein the scalar comprises the updated or maintained frequency domain gain coefficient and the vector comprises one row or column of coefficients of an IFFT based synthesis matrix.

10. A multi-band signal processor according to any of the preceding items, wherein one or more of the band gain laws of the processing gain calculator are configured to provide one of:

multi-band dynamic range compression of the audio input signal, multi-band dynamic range expansion of the audio input signal, noise reduction of the audio input signal.

11. A hearing instrument for use by a user, the hearing instrument comprising:

a first microphone for generation of a first microphone signal in response to receipt of sound, an audio input channel coupled to the first microphone signal and configured to generate a corresponding digital audio input signal, a multi-band signal processor according to any of the preceding items coupled to the digital audio input signal and configured for receipt and processing of the first microphone signal according to a hearing loss of the user, a sound reproduction channel for receipt of the processed digital output signal and conversion into audible sound for transmission to the user.

12. A method of processing a digital input audio signal to produce a processed digital output signal, comprising steps of:

a) all-pass filtering the digital input audio signal through a cascade of digital all-pass filters to generate M delayed digital audio signal samples, b) converting the M delayed digital audio signal samples to frequency domain representation in a predetermined number of frequency bands, N, to compute respective signal spectrum values, c) estimating respective signal levels in the predetermined number of frequency bands based on the signal spectrum values, d) computing respective frequency domain gain coefficients for the predetermined number of frequency bands based on the respective signal level estimates and respective band gain laws, e) transforming the frequency domain gain coefficients to time domain representation to produce M time-varying filter coefficients of a processing filter, f) convolving the M delayed digital audio signal samples with the M time-varying filter coefficients of the processing filter to produce the processed digital output signal, g) updating the M delayed digital audio signal samples in accordance with either a sample-by-sample rate or a predetermined block rate;

wherein the signal spectrum values of at least two different frequency bands are updated at different rates;

wherein each of M and N is a positive integer number.

13. A method of processing a digital input audio signal according to item 12, wherein after each sample update, or each block update, of the M delayed digital audio signal samples:

step b) comprises updating a subset of the predetermined number of frequency bands with respective signal spectrum values, step c) comprises updating respective signal level estimates of the subset of frequency bands, step d) comprises updating respective frequency domain gain coefficients of the subset of frequency bands and maintaining previous frequency domain gain coefficients of the residual frequency bands, step e) comprises converting the updated and maintained frequency domain gain coefficients into updated values of the M time-varying filter coefficients of the processing filter.

14. A method of processing a digital input audio signal according to item 13, wherein the subset of frequency bands comprises a single frequency band only.

15. A method of processing a digital input audio signal according to item 13 or 14, wherein different subsets of frequency bands are updated between consecutive sample updates, or consecutive block updates, of the M delayed digital audio signal samples in accordance with a predetermined repetitive band update schedule.

16. A computer readable data carrier comprising executable program instructions configured to cause a signal processor to execute method steps a)-g) of item 12 when executed.

The invention claimed is:

1. A multi-band signal processor comprising:

a signal input for receipt of a digital audio input signal;

a cascade of digital all-pass filters configured for receipt of the digital audio input signal and generation of M delayed digital audio signal samples at respective tapping nodes interposed between the digital all-pass filters;

a signal convolution processor configured for convolving the M delayed digital audio signal samples with M time-varying filter coefficients of a processing filter to produce a processed digital output signal;

a frequency domain transform processor configured for converting the M delayed digital audio signal samples to frequency domain representation to provide respective signal spectrum values in N number of frequency bands;

a level estimator configured to compute respective signal level estimates in the N number of frequency bands based on the respective signal spectrum values;

a processing gain calculator configured for computation of a frequency domain gain coefficient for each of the N number of frequency bands based on the respective signal level estimates and band gain laws; and an inverse frequency domain transform processor configured for conversion of the N frequency domain gain coefficients into the M time-varying filter coefficients of the processing filter;

wherein the frequency domain transform processor is configured to provide at least two of the signal spectrum values of at least two of the frequency bands at different band update rates; and wherein M is a positive integer number, and N is a positive integer number.

2. The multi-band signal processor according to claim 1, wherein the signal convolution processor is configured to be updated either sample-by-sample or updated in blocks where each block comprises a plurality of digital audio signal samples.

3. The multi-band signal processor according to claim 2, wherein the signal convolution processor is configured to be updated in a number of updates, and wherein for each of the updates:

the frequency domain transform processor is configured to update a subset of the signal spectrum values for a subset of the N number of frequency bands;

the level estimator is configured to update a subset of the signal level estimates for the subset of the N number of frequency bands; and the processing gain calculator is configured to update a subset of the frequency domain gain coefficients for the subset of the N number of frequency bands, and maintain a remaining of the frequency domain gain coefficients for a remaining of the N number of frequency bands.

4. The multi-band signal processor according to claim 3, wherein the subset of frequency bands is formed by a single frequency band of the N number of frequency bands.

5. The multi-band signal processor according to claim 3, wherein the inverse frequency domain transform processor is configured to:

convert the updated frequency domain gain coefficients and the maintained frequency domain gain coefficients into the M time-varying filter coefficients by executing a set of scalar-vector multiplications;

wherein a scalar involved in the scalar-vector multiplications comprises the updated frequency domain gain coefficients or the maintained frequency domain gain coefficient, and a vector involved in the scalar-vector multiplications comprises one row or column of coefficients of an Inverse Fast Fourier Transform (IFFT) based synthesis matrix.

6. The multi-band signal processor according to claim 1, wherein the frequency domain transform processor is configured to:

compute one of the signal spectrum values for a first frequency band of the N number of frequency bands at a first band update rate, compute another one of the signal spectrum values for a second frequency band of the N number of frequency bands at lower update rate than the first band update rate;

wherein a center frequency of the first frequency band is higher than a center frequency of the second frequency band.

7. The multi-band signal processor according to claim 1, wherein the frequency domain transform processor is configured to update the signal spectrum values for the respective frequency bands at a constant update rate.

8. The multi-band signal processor according to claim 1, wherein the frequency domain transform processor is configured to updating the signal spectrum values according to a predetermined repetitive band update schedule.

9. The multi-band signal processor according to claim 1, wherein the frequency domain transform processor is configured to compute at least one of the signal spectrum values as an inner vector product between the M delayed digital audio signal samples and windowed or un-windowed Discrete Fourier Transform coefficients of a row of a Discrete Fourier Transform matrix.

10. The multi-band signal processor according to claim 1, wherein one or more of the band gain laws are configured to provide a multi-band dynamic range compression of the digital audio input signal, a multi-band dynamic range expansion of the digital audio input signal, or a noise reduction of the digital audio input signal.

11. A hearing instrument for use by a user, the hearing instrument comprising:

the multi-band signal processor according to claim 1;

a first microphone coupled to the multi-band signal processor; and a speaker coupled to the multi-band signal processor.

12. A method of processing a digital audio input signal to produce a processed digital output signal, comprising:

all-pass filtering the digital audio input signal through a cascade of digital all-pass filters to generate M delayed digital audio signal samples;

converting, by a frequency domain transform processor, the M delayed digital audio signal samples to frequency domain representation in N number of frequency bands to compute respective signal spectrum values;

determining, by a level estimator, respective signal level estimates in the N number of frequency bands based on the signal spectrum values;

computing, by a processing gain calculator, respective frequency domain gain coefficients for the N number of frequency bands based on the respective signal level estimates and band gain laws;

transforming, by an inverse frequency domain transform processor, the frequency domain gain coefficients to time domain representation to produce M time-varying filter coefficients of a processing filter;

convolving, by a signal convolution processor, the M delayed digital audio signal samples with the M time-varying filter coefficients of the processing filter to produce the processed digital output signal; and updating the M delayed digital audio signal samples in accordance with a sample-by-sample rate or a predetermined block rate;

wherein at least two of the signal spectrum values for at least two of the N number of frequency bands are updated at different rates; and wherein M is a positive integer number, and N is a positive integer number.

13. The method according to claim 12, further comprising:

updating a subset of the signal spectrum values for a subset of the N number of frequency bands;

updating a subset of the signal level estimates for the subset of the N number of frequency bands;

updating a subset of the frequency domain gain coefficients for the subset of the N number of frequency bands; and maintaining a remaining of the frequency domain gain coefficients for a remaining of the N number of frequency bands.

14. The method according to claim 12, wherein the M delayed digital audio signal samples are updated in accordance with a predetermined repetitive band update schedule.

15. A computer product comprising a non-transitory medium storing executable program instructions, an execution of which by a signal processor will cause the method of claim 12 to be performed.

* * * * *